US008427512B2

(12) United States Patent
Smith

(10) Patent No.: US 8,427,512 B2
(45) Date of Patent: Apr. 23, 2013

(54) DISPLAY DRIVE SYSTEMS

(75) Inventor: Euan Smith, Longstanton (GB)

(73) Assignee: Cambridge Display Technology Limited, Cambridgeshire (GB)

( * ) Notice: Subject to any disclaimer, the term of this patent is extended or adjusted under 35 U.S.C. 154(b) by 901 days.

(21) Appl. No.: 12/439,162

(22) PCT Filed: Aug. 30, 2007

(86) PCT No.: PCT/GB2007/003279

§ 371 (c)(1),
(2), (4) Date: May 28, 2009

(87) PCT Pub. No.: WO2008/025985

PCT Pub. Date: Mar. 6, 2008

(65) Prior Publication Data

US 2010/0026725 A1 Feb. 4, 2010

(30) Foreign Application Priority Data

Aug. 31, 2006 (GB) ..... 0617111.0

(51) Int. Cl.
*G09G 5/10* (2006.01)

(52) U.S. Cl.
USPC ..... 345/690

(58) Field of Classification Search ..... 345/76–98, 345/204–214, 690; 313/500; 257/10, E27.133, 257/E51.018, 98, 565
See application file for complete search history.

(56) References Cited

U.S. PATENT DOCUMENTS 4,539,507 A 9/1985 VanSlyke et al.
6,014,119 A 1/2000 Staring et al.
6,201,520 B1 3/2001 Iketsu et al.
6,332,661 B1 12/2001 Yamaguchi
7,079,091 B2 * 7/2006 Kondakov et al. ..... 345/76
7,116,292 B2 * 10/2006 Ozawa ..... 345/76
7,190,122 B2 * 3/2007 Winters et al. ..... 315/169.1
7,375,473 B2 * 5/2008 Cok ..... 315/308
7,482,629 B2 * 1/2009 Hayakawa et al. ..... 257/59
7,619,597 B2 * 11/2009 Nathan et al. ..... 345/82

(Continued)

FOREIGN PATENT DOCUMENTS

EP 0717446 6/1996
EP 0880303 11/1998

(Continued)

OTHER PUBLICATIONS

International Search Report and Written Opinion for PCT/GB2007/003279 dated Nov. 7, 2007.

*Primary Examiner* — Prabodh M Dharia
(74) *Attorney, Agent, or Firm* — Marshall, Gerstein & Borun LLP

(57) ABSTRACT

This invention generally relates to methods, apparatus and computer program code for improved OLED (organic light emitting diode) display drive systems, in particular to compensate for burn-in.

A method of compensating an OLED display device for burn-in of pixels of the OLED display, the method comprising: measuring a first voltage drop across at least one test pixel of the display; measuring a second voltage drop across at least one other pixel of the display; determining, from said first and second voltages and a from value ($V_1$) representing a drive voltage increase for a loss in efficiency of said display due to burn-in, an estimated reduction in efficiency of said display due to burn-in; and compensating a drive to said display using said estimated efficiency reduction.

14 Claims, 7 Drawing Sheets

U.S. PATENT DOCUMENTS

| | | | | |
|---|---|---|---|---|
| 2002/0047565 | A1* | 4/2002 | Nara et al. | 315/169.3 |
| 2003/0165715 | A1* | 9/2003 | Yoon et al. | 428/690 |
| 2003/0201727 | A1 | 10/2003 | Yamazaki et al. | |
| 2004/0070558 | A1* | 4/2004 | Cok et al. | 345/76 |
| 2004/0135749 | A1* | 7/2004 | Kondakov et al. | 345/82 |
| 2004/0164935 | A1* | 8/2004 | Dedene et al. | 345/75.2 |
| 2004/0201555 | A1* | 10/2004 | Ozawa | 345/76 |
| 2005/0110786 | A1 | 5/2005 | Inoue et al. | |
| 2006/0022305 | A1* | 2/2006 | Yamashita | 257/565 |
| 2006/0145969 | A1* | 7/2006 | Fish et al. | 345/77 |
| 2006/0158402 | A1* | 7/2006 | Nathan et al. | 345/82 |
| 2006/0197458 | A1* | 9/2006 | Winters et al. | 315/169.1 |
| 2007/0139437 | A1* | 6/2007 | Boroson et al. | 345/590 |
| 2007/0182442 | A1* | 8/2007 | Hata et al. | 324/770 |
| 2007/0217220 | A1* | 9/2007 | Kang et al. | 362/612 |
| 2008/0048951 | A1* | 2/2008 | Naugler et al. | 345/82 |

FOREIGN PATENT DOCUMENTS

| | | |
|---|---|---|
| EP | 1079361 | 2/2001 |
| EP | 1091339 | 4/2001 |
| EP | 1158483 | 11/2001 |
| GB | 2 439 584 | 1/2008 |
| WO | WO-9013148 | 11/1990 |
| WO | WO-9506400 | 3/1995 |
| WO | WO-9921935 | 5/1999 |
| WO | WO-9948160 | 9/1999 |
| WO | WO-02067343 | 8/2002 |
| WO | WO-03/079322 | 9/2003 |
| WO | WO-03/091983 | 11/2003 |
| WO | WO-03/107313 | 12/2003 |
| WO | WO-03/107318 | 12/2003 |
| WO | WO-2007/053783 | 5/2007 |

* cited by examiner

300

DISPLAY DRIVE SYSTEMS

BACKGROUND OF THE INVENTION

This invention generally relates to methods, apparatus and computer program code for improved OLED (organic light emitting diode) display drive systems, in particular to compensate for burn-in.

RELATED TECHNOLOGY

Organic light emitting diodes, which here include organometallic LEDs, may be fabricated using materials including polymers, small molecules and dendrimers, in a range of colours which depend upon the materials employed. Examples of polymer-based organic LEDs are described in WO 90/13148, WO 95/06400 and WO 99/48160; examples of dendrimer-based materials are described in WO 99/21935 and WO 02/067343; and examples of so called small molecule based devices are described in U.S. Pat. No. 4,539,507. A typical OLED device comprises two layers of organic material, one of which is a layer of light emitting material such as a light emitting polymer (LEP), oligomer or a light emitting low molecular weight material, and the other of which is a layer of a hole transporting material such as a polythiophene derivative or a polyaniline derivative.

Organic LEDs may be deposited on a substrate in a matrix of pixels to form a single or multi-colour pixellated display. A multicoloured display may be constructed using groups of red, green, and blue emitting sub-pixels. So-called active matrix displays have a memory element, typically a storage capacitor and a transistor, associated with each pixel whilst passive matrix displays have no such memory element and instead are repetitively scanned to give the impression of a steady image. Other passive displays include segmented displays in which a plurality of segments share a common electrode and a segment may be lit up by applying a voltage to its other electrode. A simple segmented display need not be scanned but in a display comprising a plurality of segmented regions the electrodes may be multiplexed (to reduce their number) and then scanned.

FIG. 1*a* shows a vertical cross section through an example of an OLED device 100. In an active matrix display part of the area of a pixel is occupied by associated drive circuitry (not shown in FIG. 1*a*). The structure of the device is somewhat simplified for the purposes of illustration.

The OLED 100 comprises a substrate 102, typically 0.7 mm or 1.1 mm glass but optionally clear plastic or some other substantially transparent material. An anode layer 104 is deposited on the substrate, typically comprising around 150 nm thickness of ITO (indium tin oxide), over part of which is provided a metal contact layer. Typically the contact layer comprises around 500 nm of aluminium, or a layer of aluminium sandwiched between layers of chrome, and this is sometimes referred to as anode metal. Glass substrates coated with ITO and contact metal are available from Corning, USA. The contact metal over the ITO helps provide reduced resistance pathways where the anode connections do not need to be transparent, in particular for external contacts to the device. The contact metal is removed from the ITO where it is not wanted, in particular where it would otherwise obscure the display, by a standard process of photolithography followed by etching.

A substantially transparent hole transport layer 106 is deposited over the anode layer, followed by an electroluminescent layer 108, and a cathode 110. The electroluminescent layer 108 may comprise, for example, a PPV (poly(p-phenylenevinylene)) and the hole transport layer 106, which helps match the hole energy levels of the anode layer 104 and electroluminescent layer 108, may comprise a conductive transparent polymer, for example PEDOT:PSS (polystyrene-sulphonate-doped polyethylene-dioxythiophene) from Bayer AG of Germany. In a typical polymer-based device the hole transport layer 106 may comprise around 200 nm of PEDOT; a light emitting polymer layer 108 is typically around 70 nm in thickness.

These organic layers may be deposited by spin coating (afterwards removing material from unwanted areas by plasma etching or laser ablation) or by inkjet printing in this latter case banks 112 may be formed on the substrate, for example using photoresist, to define wells into which the organic layers may be deposited. Such wells define light emitting areas or pixels of the display.

Cathode layer 110 typically comprises a low work function metal such as calcium or barium (for example deposited by physical vapour deposition) covered with a thicker, capping layer of aluminium. Optionally an additional layer may be provided immediately adjacent the electroluminescent layer, such as a layer of barium fluoride, for improved electron energy level matching. Mutual electrical isolation of cathode lines may be achieved or enhanced through the use of cathode separators (not shown in FIG. 1*a*).

The same basic structure may also be employed for small molecule and dendrimer devices. Typically a number of displays are fabricated on a single substrate and at the end of the fabrication process the substrate is scribed, and the displays separated before an encapsulating can is attached to each to inhibit oxidation and moisture ingress.

To illuminate the OLED power is applied between the anode and cathode, represented in FIG. 1*a* by battery 118. In the example shown in FIG. 1*a* light is emitted through transparent anode 104 and substrate 102 and the cathode is generally reflective; such devices are referred to as "bottom emitters". Devices which emit through the cathode ("top emitters") may also be constructed, for example by keeping the thickness of cathode layer 110 less than around 50-100 nm so that the cathode is substantially transparent.

It will be appreciated that the foregoing description is merely illustrative of one type of OLED display, to assist in understanding some applications of embodiments of the invention. There is a variety of other types of OLED, including reverse devices where the cathode is on the bottom such as those produced by Novaled GmbH. Moreover application of embodiments of the invention are not limited to displays, OLED or otherwise.

Organic LEDs may be deposited on a substrate in a matrix of pixels to form a single or multi-colour pixellated display. A multicoloured display may be constructed using groups of red, green, and blue emitting pixels. In such displays the individual elements are generally addressed by activating row (or column) lines to select the pixels, and rows (or columns) of pixels are written to, to create a display. So-called active matrix displays have a memory element, typically a storage capacitor and a transistor, associated with each pixel whilst passive matrix displays have no such memory element and instead are repetitively scanned, somewhat similarly to a TV picture, to give the impression of a steady image.

Referring now to FIG. 1*b*, this shows a simplified cross-section through a passive matrix OLED display device 150, in which like elements to those of FIG. 1*a* are indicated by like reference numerals. As shown the hole transport 106 and electroluminescent 108 layers are subdivided into a plurality of pixels 152 at the intersection of mutually perpendicular anode and cathode lines defined in the anode metal 104 and cathode layer 110 respectively. In the figure conductive lines 154 defined in the cathode layer 110 run into the page and a cross-section through one of a plurality of anode lines 158 running at right angles to the cathode lines is shown. An electroluminescent pixel 152 at the intersection of a cathode and anode line may be addressed by applying a voltage between the relevant lines. The anode metal layer 104 provides external contacts to the display 150 and may be used for both anode and cathode connections to the OLEDs (by running the cathode layer pattern over anode metal lead-outs). The above mentioned OLED materials, in particular the light emitting polymer and the cathode, are susceptible to oxidation and to moisture and the device is therefore encapsulated in a metal can 111, attached by UV-curable epoxy glue 113 onto anode metal layer 104, small glass beads within the glue preventing the metal can touching and shorting out the contacts.

Referring now to FIG. 2, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative and with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Preferably, however, to allow individual pixels to remain on for longer and hence reduce overall drive level, a row is selected and all the columns written in parallel, that is a current driven onto each of the column lines simultaneously to illuminate each pixel in a row at its desired brightness. Each pixel in a column could be addressed in turn before the next column is addressed but this is not preferred because, inter alia, of the effect of column capacitance.

The skilled person will appreciate that in a passive matrix OLED display it is arbitrary which electrodes are labelled row electrodes and which column electrodes, and in this specification "row" and "column are used interchangeably.

It is usual to provide a current-controlled rather than a voltage-controlled drive to an OLED because the brightness of an OLED is determined by the current flowing through the device, this determining the number of photons it generates. In a voltage-controlled configuration the brightness can vary across the area of a display and with time, temperature, and age, making it difficult to predict how bright a pixel will appear when driven by a given voltage. In a colour display the accuracy of colour representations may also be affected.

The conventional method of varying pixel brightness is to vary pixel on-time using Pulse Width Modulation (PWM). In a conventional PWM scheme a pixel is either full on or completely off but the apparent brightness of a pixel varies because of integration within the observer's eye. An alternative method is to vary the column drive current.

FIG. 3 shows a schematic diagram 300 of a driver for a passive matrix OLED display suitable for implementing embodiments of the invention, as described further later. The OLED display is indicated by dashed line 302 and comprises a plurality n of row lines 304 each with a corresponding row electrode contact 306 and a plurality m of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 318. A power supply 320 provides power to the circuitry and, in particular, to y-driver 314.

Some examples of OLED display drivers are described in U.S. Pat. No. 6,014,119, U.S. Pat. No. 6,201,520, U.S. Pat. No. 6,332,661, EP 1,079,361A and EP 1,091,339A and OLED display driver integrated circuits employing PWM are sold by Clare Micronix of Clare, Inc., Beverly, Mass., USA. Some examples of improved OLED display drivers are described in the Applicant's co-pending applications WO 03/079322 and WO 03/091983. In particular WO 03/079322, hereby incorporated by reference, describes a digitally controllable programmable current generator with improved compliance.

One problem associated with OLED displays is that, over time, the pixels "burn-in", that is the drive voltage required for a given drive current (and hence luminosity) increases with use. In particular, luminosity at a given current may fall sharply during initial driving of an OLED display, with subsequent luminosity decaying more uniformly. Thus two different but related problems can arise from burn-in: firstly a general aging of the display with use, and secondly image burn-in, where persistent display of an image can cause differential aging of pixels of the display. Screen savers provide one technique for addressing this problem, but only in the context of computer monitor display and, for example, it is becoming more common for television channels to display a persistent logo or other branding discreetly in a corner of the screen. A further problem associated with OLED displays is that displays that are stored but not driven for an extended period of time may suffer from decreased luminosity as compared to a display that is driven without having been stored for extended periods. Possible reasons for this decreased luminosity may be ingress of moisture and oxygen into an imperfectly encapsulated display or migration of chemical species from one layer of the display to another (for example, migration of metal ions from a cathode layer into an organic layer).

For many OLED material systems the increase in drive voltage with driven time for a given current and temperature can be correlated to the decay in device efficiency. One could attempt to implement a compensation scheme which monitors the voltage drop across an OLED and which corrects the drive signal accordingly. However this approach suffers from a drawback in that the voltage drop across the OLED also varies with temperature, and this could result in a brightness variation across the display proportional to temperature across the display.

SUMMARY OF THE INVENTION

According to the present invention there is therefore provided a method of compensating an OLED display device for burn-in of pixels of the OLED display, the method comprising: measuring a first voltage drop across at least one test pixel of the display; measuring a second voltage drop across at least one other pixel of the display; determining, from said first and second voltages and a from value ($V_1$) representing a drive voltage increase for a loss in efficiency of said display due to burn-in, an estimated reduction in efficiency of said display due to burn-in; and compensating a drive to said display using said estimated efficiency reduction.

Preferably the value representing a voltage increase for a loss in the efficiency of the display represents an increase in a pixel drive voltage needed to compensate for a defined level of efficiency reduction, for example 50% (corresponding to a 50% drop in OLED brightness). This defined level of efficiency reduction can be used to define an (arbitrary) end of life for the OLED pixel. With this example, because the response of the human eye is non-linear a 50% reduction in actual brightness corresponds to something like an 80% reduction in perceived brightness. The determining of the estimated reduction in efficiency of the display (which may be defined as a ratio of end-of-life efficiency to initial efficiency) may then employ a relationship dependent upon this defined level of efficiency reduction—that is, in effect, the increase in pixel drive voltage is defined in relation to a predetermined level of efficiency reduction such as the aforementioned 50%. The increase in the pixel drive voltage is preferably stored, for example on a driver integrated circuit; the value may be initially derived from laboratory measurements made for a device or on one of a batch of manufactured devices.

Broadly speaking, in embodiments of the method the voltage drop across the test pixel comprises a temperature-dependent voltage drop and thus by taking this into account the method can automatically compensate for temperature variations of the display. (The end-of-life increase in pixel drive voltage is not particularly temperature dependent). Nonetheless it is strongly preferable that the first and second voltage drops are measured at (immediately or soon after) switch-on of the display, that is when the display is at a substantially uniform temperature. In a more sophisticated implementation provision may be made to determine whether the display has been switched off for a sufficiently long period to have cooled down so that the reduction in efficiency may be estimated only when the pixels of the display have reached approximately the same temperature. This may be implemented in practice using, for example, a low-leakage capacitor as a timing element.

In preferred embodiments of the method the compensating for reduced efficiency comprises increasing a drive current to a pixel of the display by a factor dependent upon an inverse of the estimated efficiency reduction. This is because OLEDs are preferably operated as current-controlled devices, when there is a substantially linear relationship between the current through the device and the OLED brightness.

In some embodiments of the method the efficiency reduction may be estimated based upon just two measurements, that on the test pixel and that on one other pixel, and this estimated efficiency reduction may be used to compensate drive signals for the whole display. This may provide sufficiently accurate compensation for the burn-in. However in other embodiments of the method a said second voltage drop may be measured for a plurality of pixels of the display and an average calculated for use in determining the efficiency reduction. Alternatively a number of different efficiency reduction values may be determined from the measured pixels and these may then be used to compensate those pixels and regions in their vicinity. For example a display could be subdivided into two, four or more partitions for separate compensation in this way.

In one embodiment of the method the test pixel comprises a dummy pixel, not used for displaying information. For example the test pixel may be in an unused, edge portion of the display. In other embodiments the test pixel may be in an active region of the display, that is a part of the display used for displaying information under normal operating conditions. In these embodiments the other pixels are corrected relative to the selected test pixel or pixels. In some versions of these embodiments the test pixel is selected from the 20% of pixels of the display having least aging. Thus in some preferred embodiments a test pixel may comprise a substantially least aged pixel of the display. The one or more least aged pixels of the display may be identified by measuring a current voltage drop for a given, test drive current, the least aged pixel having the least current voltage drop. Alternatively the time for which a pixel is on at greater than a threshold value, for example 50%, may be monitored to find the least aged pixel or pixels.

The skilled person will understand that multiple test pixels (either active or dummy) may be employed. Then either an average first voltage drop may be determined or separate efficiency reduction estimations may be made based upon the multiple test pixels, these being used to compensate the display, for example in different respective regions of the display.

In embodiments of the method where the test pixel comprises a pixel which is active in normal display use the method may compensate the drive to the display by determining the reduction (or otherwise) in efficiency of one or more other pixels in relation to the monitored pixel. In particular the method may include measuring a time for which an active test pixel is on, for example at greater than a threshold drive level, say 50%. Knowing this on-time the estimated drive voltage increase may be predicted (by predicting an estimated reduction in efficiency of the test pixel) and since the actual voltage drop is measured this may be employed to provide an indirect measure of the temperature of the test pixel or, more generally, of the display. Optionally an actual estimated temperature for the display may be determined, although this is not necessary. This information may then be used to compensate the drive to other pixels of the display by compensating for the temperature of the display using the measured on-time, more particularly by comparing the measured voltage drop of the test pixel with the predicted voltage drop. With embodiments of such a method multiple test pixels across the display may be employed to provide improved compensation taking account of possible temperature differences across the display, in embodiments by averaging voltage drops across a plurality of "active" test pixels.

The skilled person will understand that the above-described techniques may be applied to both monochrome and colour displays; thus references to a pixel include sub-pixels of a colour display. In a colour display two or three of the different colours, typically red, blue and green, may be monitored and compensated separately, or an average compensation may be determined and applied to all the colours, optionally with a colour-dependent adjustment factor. It may be desirable, for example, to estimate and compensate for efficiency reduction in blue sub-pixels separately to red and/or green coloured sub-pixels.

In a related aspect the invention provides a method of controlling a drive to a pixel of an OLED display, the method comprising determining a drive voltage, V, for said pixel using:

$$V = V_0 + \frac{1}{1-\alpha} V_1 \left(1 - \frac{\eta}{\eta_0}\right)$$

where $V_0$ and $\eta_0$ are a voltage drive to said pixel at a test drive current and a luminance efficiency of said pixel at said test drive current at an initial time; and $V_1$ is an end of life voltage increase in said voltage drive for said test drive current; and wherein said end of life is defined as a point at which an efficiency, $\eta$, of said pixel has fallen to $\alpha$ of an initial efficiency value ($\eta_0$) at said initial time.

In a further related aspect the invention provides an OLED display driver, the display driver comprising: an input for measuring a first voltage drop across at least one test pixel of the display; an input for measuring a second voltage drop across at least one other pixel of the display; a store storing a value ($V_1$) representing a drive voltage increase for a loss in efficiency of said display; a system for determining an estimated reduction in efficiency of said display from said first and second voltages and said value ($V_1$) representing said drive voltage increase for a loss in efficiency of said display; and a system for compensating a drive to said display using said estimated efficiency reduction.

Embodiments of the above display driver may be employed in combination with an OLED display, in particular an active matrix OLED display. Preferably such an active matrix OLED display is configured for measuring a voltage across an OLED device of a pixel of the display.

Thus in a further aspect the invention provides an active matrix OLED display pixel driver circuit said pixel driver circuit including a transistor having an input connection coupled to an OLED device of the pixel for measuring a voltage across said OLED device, an output coupled to a first electrode line of said display and a control connection coupled to a second electrode line of said display.

In embodiments the extra transistor of the pixel driver circuit need not be implemented in every pixel of an active matrix display, but only on a few of the pixels, that is those for which voltage drop measurements are desired. In embodiments the pixel driver circuit is implemented in a row (or column) of the display and the second electrode line comprises a power supply line of an adjacent row (or column) of the display. Preferably the second electrode line comprises a positive supply line and the transistor is controlled on by pulling the control connection low. In this way there is no need for an additional select line because the voltage supply line for, say, the row of pixels below the pixel to be measured can be used as a select line.

In a passive matrix display the voltage drop across an OLED device is generally accessible substantially directly via the relevant row and column lines. In both an active and a passive matrix display optionally provision may be made to compensate for electrode line resistance, for example by performing a calibration at the design stage and incorporating a line resistance compensation factor in the display driver/method.

As previously mentioned, preferably the system for measuring the voltage drops is responsive to switch-on of the display so that the measurements can be made at or soon after switch-on. The measurements need not be made every time the display is switched on and may be made, for example, every tenth switch on.

The invention further provides a carrier medium carrying processor control code to implement the above-described methods and display drivers. This code may comprise conventional program code, for example source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog (Trade Mark) or VHDL (Very high speed integrated circuit Hardware Description Language). Such code may be distributed between a plurality of coupled components. The carrier medium may comprise any conventional storage medium such as a disk or programmed memory (for example firmware such as Flash RAM or ROM), or a data carrier such as an optical or electrical signal carrier.

BRIEF DESCRIPTION OF THE DRAWINGS

These and other aspects of the of the invention will now be further described, by way of example only, with the reference to the accompanying figures in which:

FIGS. 4*a* to 4*c* show, respectively, a graph of OLED efficiency against time, a graph of OLED drive voltage against time, and a flow diagram of a procedure for compensating an OLED display device for burn-in.

DETAILED DESCRIPTION OF PREFERRED EMBODIMENTS

Figure 4A:
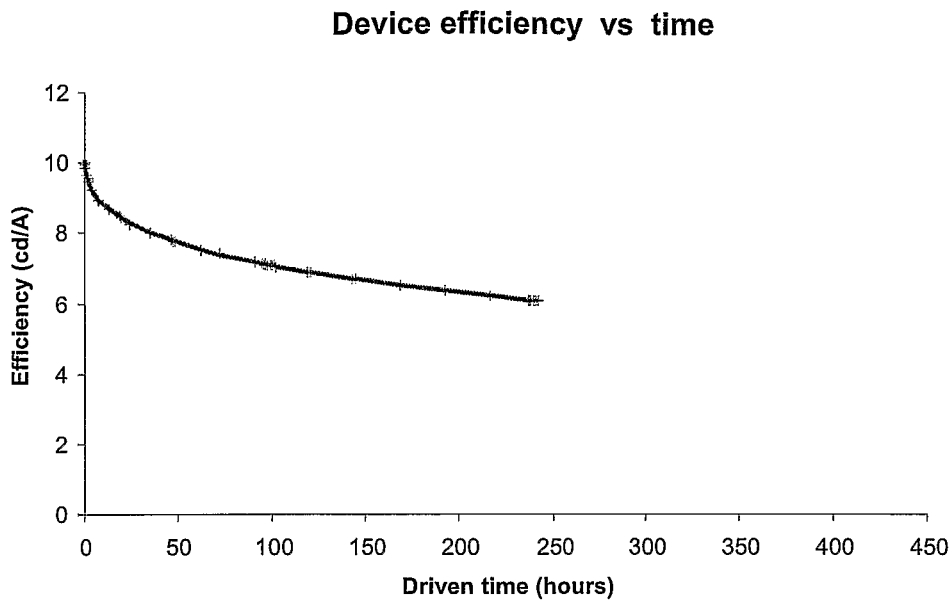
Figure 4B:
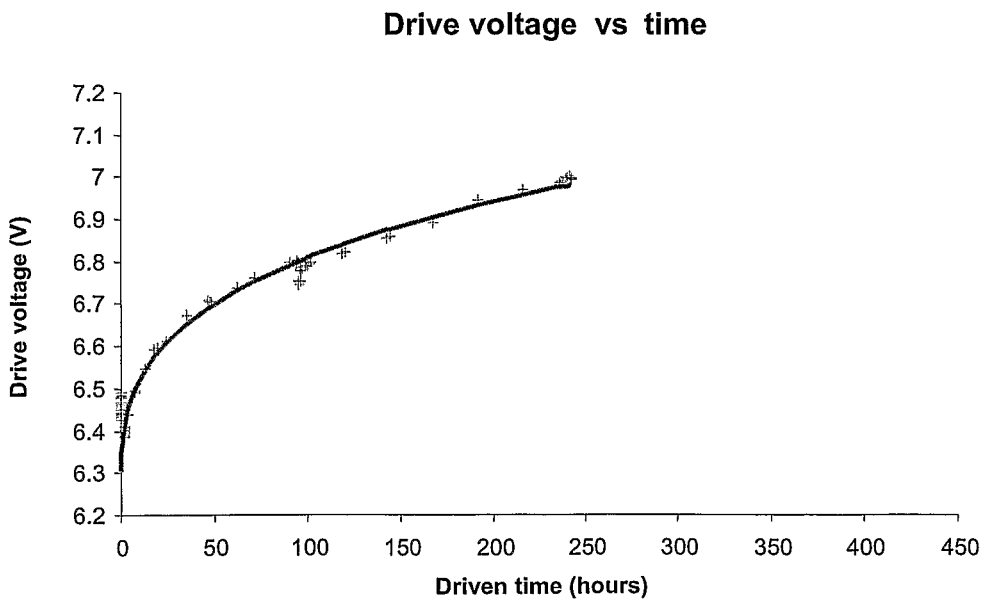

Referring to FIGS. 4*a* and 4*b* these show, respectively, the efficiency of an OLED (in candelas per amp) and the drive voltage of an OLED (in volts) against driven time (in hours). Both graphs have been fitted with the same stretched exponential function, $$\exp-\left(\frac{t}{\tau}\right)^n \text{ or } 1-\exp-\left(\frac{t}{\tau}\right)^n$$

and it can be seen that tnere is a strong correlation between the fall-off in efficiency of the OLED device and the increased drive voltage needed for the same drive current/light output. The drive voltage, V, can be expressed as follows:

$$V = V_0 + 2V_1\left(1-\frac{\eta}{\eta_0}\right) \tag{1}$$

where $V_0$ and $\eta_0$ are the voltage and efficiency at time t=0, and $V_1$ is the end-of-life voltage increase. As previously mentioned in embodiments of the invention we arbitrarily define the end-of-life as the half-efficiency point so that in Equation (1) above at the end-of-life point $\eta/\eta_0=½$ and thus $V=V_0+V_1$.

In Equation (1) $V_0$ is dependent upon the temperature, T, of the OLED device and may be specified, for example, at 25° C.; to make this clearer $V_0$ may be written as $V_0$ (T). Nonetheless we will describe how, in embodiments of the invention, it is not necessary to know the temperature in order to make use of Equation (1). The value of $V_1$ is not very temperature dependent. We will describe a number of techniques which may be employed to correct burn-in, in particular image burn-in, on an OLED display, based upon the above observations and upon Equation (1). In general these techniques employ monitoring of OLED current-voltage characteristics, for example a voltage drop across an OLED device at a given drive current, preferably at switch-on. Broadly speaking the techniques use the increase in drive voltage, compared between pixels on the display, at a test current, to correct for burn-in. In this way burn-in effects on the display may be reduced.

A first technique is to include one or a number of test pixels around the edge of the display which are used as a reference. At turn-on the voltage drop over one, some or all OLEDs in the display is measured and compared to the test device(s). This can substantially remove the dependence on temperature, although it is preferable that this test takes place at initial turn-on, when the whole display is at a uniform temperature.

A second method does not use external reference devices, but rather compares OLEDs in the display to each other, in particular by using the device with the smallest voltage drop (i.e. the least aged) as the reference and correcting one, some or all the other efficiency drop(s) as if this device were pristine. This gives, to first order, a correction for image burn-in although not for overall display aging. However it is image burn-in which is generally by far the most significant of the two issues.

A further method is to pick one (or more) particular pixel(s) in the display and to accurately track its use and voltage drop. The voltage drops of one, some or all other pixels in the display are compared to this one and, since the degree of aging experienced by this pixel is known, the aging of the others can be ascertained.

A modification of this method is to use a selection of pixels across the display as references. Each other pixel may then be referenced to the tracked pixel closest to it. This can help to reduce the impact of possible temperature variations over the display area.

All these techniques are applicable to both active and passive matrix displays. Optimally voltage drops due to track resistances can be corrected for.

Referring again to Equation (1) above, consider first the case of a dummy (unused) test pixel. Since this is not aged $\eta=\eta_0$ and hence a measurement of the voltage drop across this test pixel, $V_{now}^{test}$ at a set drive current provides a value for $V_0$ (at the current temperature). Thus for another pixel of the display the voltage drop is given by $$V_{now}^{test} = V_{now}^{other} + 2V_1\left(1 - \frac{\eta}{\eta_0}\right) \tag{2}$$

This can be used to calculate a value of $$\frac{\eta}{\eta_0}$$

for the display or, for multiple other pixels, an average value of $\eta/\eta_0$ or, alternatively, a value of $\eta/\eta_0$ for each pixel of the display (or each colour sub-pixel) or for regions of the display. Once this value has been obtained the inverse, $$\frac{\eta}{\eta_0}$$

can be used to scale the drive current or, for a voltage-controlled pixel, to determine a desired drive current from which a drive voltage can be obtained. Thus in embodiments a drive signal can be scaled as follows:

$$DRIVE_{now} = DRIVE_{requested} \times \frac{\eta_0}{\eta} \tag{3}$$

Figure 4C:
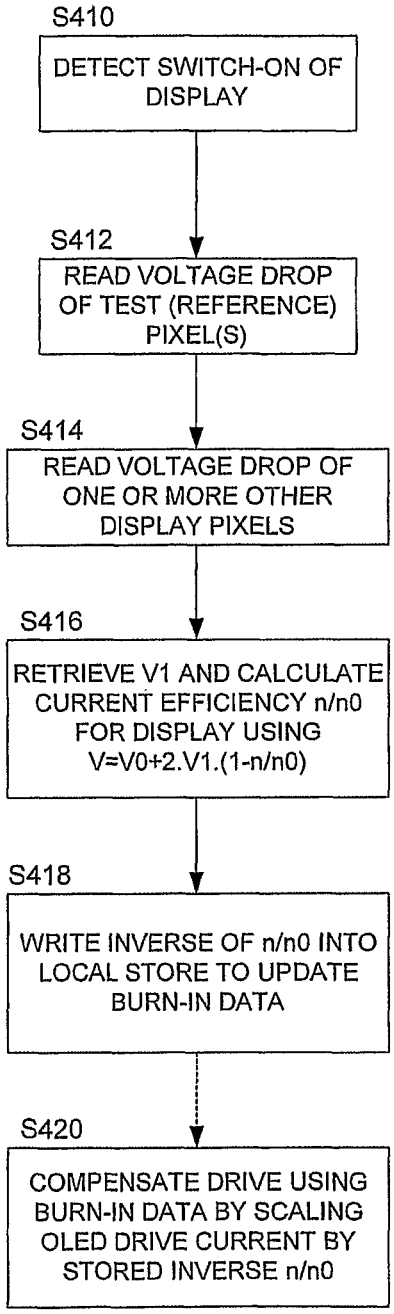

Referring now to FIG. 4*c*, this shows a procedure to implement the above-described method, for example in computer program code. Thus at step S410 the procedure detects switch-on of the display and then reads a voltage drop across one or more test (reference) pixels and a voltage drop across one or more other, display pixels (S412, S414). Then the procedure retrieves a value for $V_1$, for example stored on a driver chip at manufacture, and calculates a current efficiency for the display, $$\frac{\eta}{\eta_0},$$

using Equation (1) above (S416. An average value of $$\frac{\eta}{\eta_0}$$

may be calculated for the whole display but in some preferred embodiments a value of $$\frac{\eta}{\eta_0}$$

may be calculated for each pixel or sub-pixel of the display. This data is written into local storage, for example Flash memory to update the burn-in compensation data (S418). This concludes the burn-in calibration. Subsequently during operation of the display a requested drive, for example a drive current, is compensated using the stored efficiency data, either separately for each pixel or using the global value for the display, in particular by scaling a pixel drive in accordance with Equation (3).

In the second of the above-described methods an active pixel of the display rather than a dummy pixel is used as the test pixel for the calibration. In particular a least aged pixel is employed as may be determined by measuring the on-time of each pixel or as may be determined by identifying a pixel with a minimum voltage drop. The latter determination is straightforward in a passive matrix display; in an active matrix display the determination may be made by providing circuitry to allow the voltage drop of each pixel (more precisely an OLED image pixel) to be monitored, as described further below. The voltage drop across the OLED of this least-aged pixel, $V_{now}^{min}$, is given by:

$$V_{now}^{min} = V_0 + 2V_1\left(1 - \frac{\eta^m}{\eta_0}\right) \quad (4)$$

where $\eta^m$ is the current efficiency of the minimum-aged pixel. Now subtracting Equation 2 from Equation 4 we have:

$$V_{now}^{other} - V_{now}^{min} = \left[\left(1 - \frac{\eta}{\eta_0}\right) - \left(1 - \frac{\eta^m}{\eta_0}\right)\right]2V_1 \quad (5)$$

Rearranging:

$$\frac{\Delta V}{2V_1} = \frac{\eta^m}{\eta_0} - \frac{\eta}{\eta_0} \quad (6)$$

where $\Delta V = V_{now}^{other} - V_{now}^{min}$. Thus:

$$1 - \frac{\Delta V}{2V_1} = 1 - \frac{\eta^m}{\eta_0} + \frac{\eta}{\eta_0} \approx \frac{\eta}{\eta_0} \quad (7)$$

$$\text{if } \frac{\eta^m}{\eta_0} \approx 1.$$

We have measured $\Delta V$ and know $V_1$ and can therefore calculate the scaling factor $$\frac{\eta}{\eta_0}$$

as the left hand side of Equation (7), for use in Equation (3) above.

Referring again to Equation (7), the scaling factor is:

$$\left(1 - \frac{\eta^m}{\eta_0} + \frac{\eta}{\eta_0}\right)^{-1} = \left(\frac{\eta + \eta_0 - \eta^m}{\eta_0}\right)^{-1}$$

and therefore the scaled luminance for the "other" pixel is:

$$L^{other} = \eta\left(\frac{\eta + \eta_0 - \eta^m}{\eta_0}\right)^{-1}$$

$$J = \frac{\eta\eta_0}{\eta + \eta_0 - \eta^m} J \approx \eta^m J$$

where J is current density (equivalent to drive current). From this it can be seen that the luminance of the other pixel is scaled approximately to that of the minimum aged pixel (although here there is no overall age compensation).

The error in assuming that $$\frac{\eta^m}{\eta_0}$$

is approximately unity can be calculated and for a ratio of 0.9 is approximately 1%, for a ratio of 0.8 is approximately 5% and for a ratio of 0.0.7 is approximately 10%. In terms of an error in the compensation applied, as opposed to the actual drive signal, this is acceptable in many circumstances.

The above-described method may be implemented by substantially the same procedure as shown in FIG. 4*c* and described above.

In a further alternative method the use of one or more active test pixels in the display is monitored to determine an on-time, $t_{ON}$, from which a drop in efficiency may be predicted according to Equation (8) below in which T and n are known, for example having previously been measured for the relevant OLED material and stored on-chip:

$$\frac{\eta}{\eta_0} = \exp - \left(\frac{t_{ON}}{\tau}\right)^n \quad (8)$$

From this a value for $V_0$ may be calculated:

$$V_{now}^{test} = V_0(T) + \left(1 - \frac{\eta}{\eta_0}\right)_{calc} 2V_1 \quad (9)$$

where the temperature dependence of $V_0$ is shown explicitly. Then a value for the current efficiency of another pixel, $$\frac{\eta}{\eta_0},$$

may be determined as follows:

$$V_{now}^{other} = V_0(T) + \left(1 - \frac{\eta}{\eta_0}\right)2V_1 \quad (10)$$

Optionally an average over multiple test pixels may be employed to determine $V_0$ (T). Additionally or alternatively different values of $V_0$ (T) may be determined for different regions of the display. In either case better robustness against temperature changes across the display may be achieved.

Again embodiments of this method may be implemented by a procedure similar to that in FIG. 4*c*, with the addition of a step to predict an efficiency drop of a test pixel based upon its tracked use.

Figure 1A:
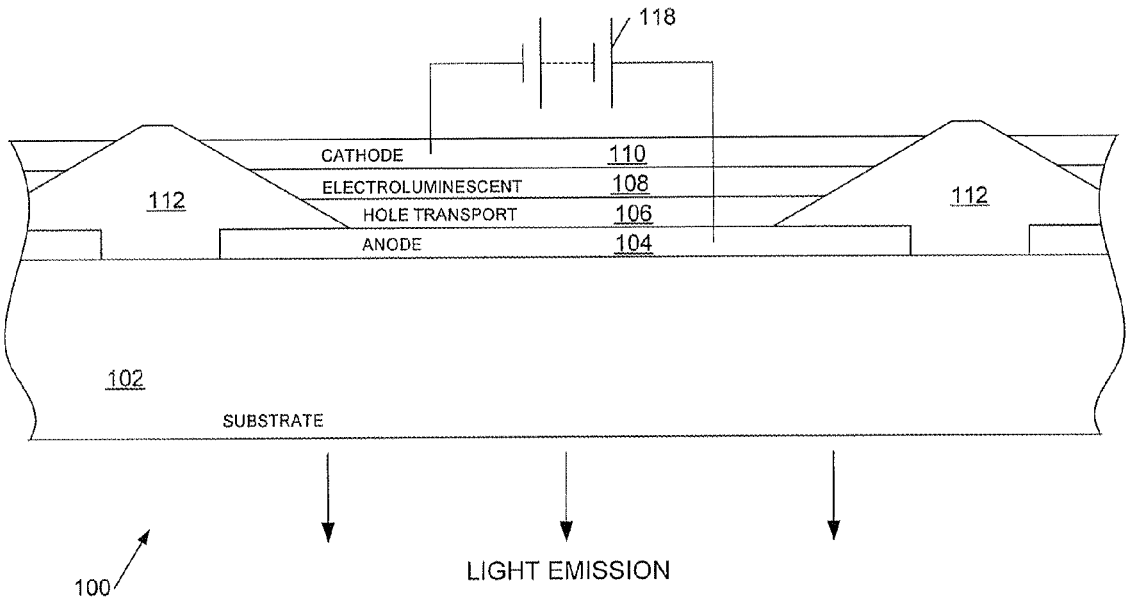
Figure 1a (PRIOR ART)
FIGS. 1*a* and 1*b* show, respectively, a vertical cross section through an OLED device, and a simplified cross section through a passive matrix OLED display.
Figure 1B:
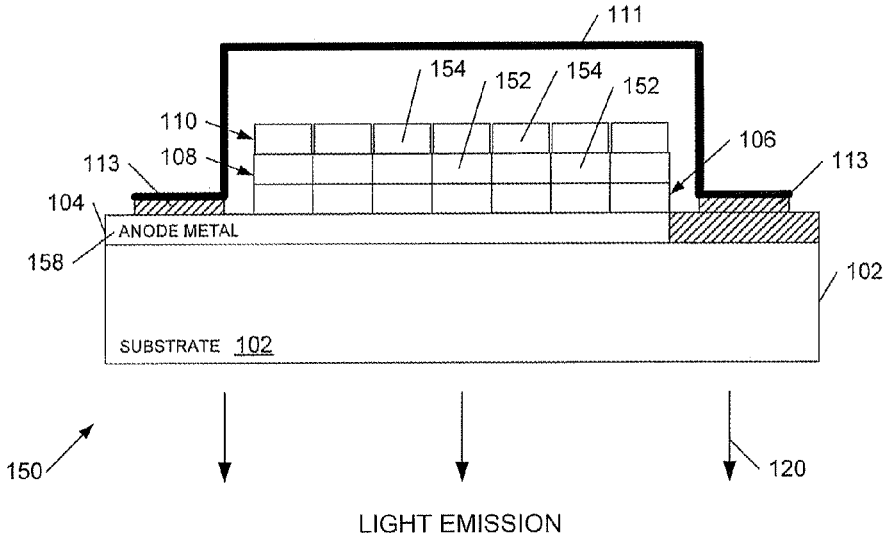
Figure 1b (PRIOR ART)
Figure 2:
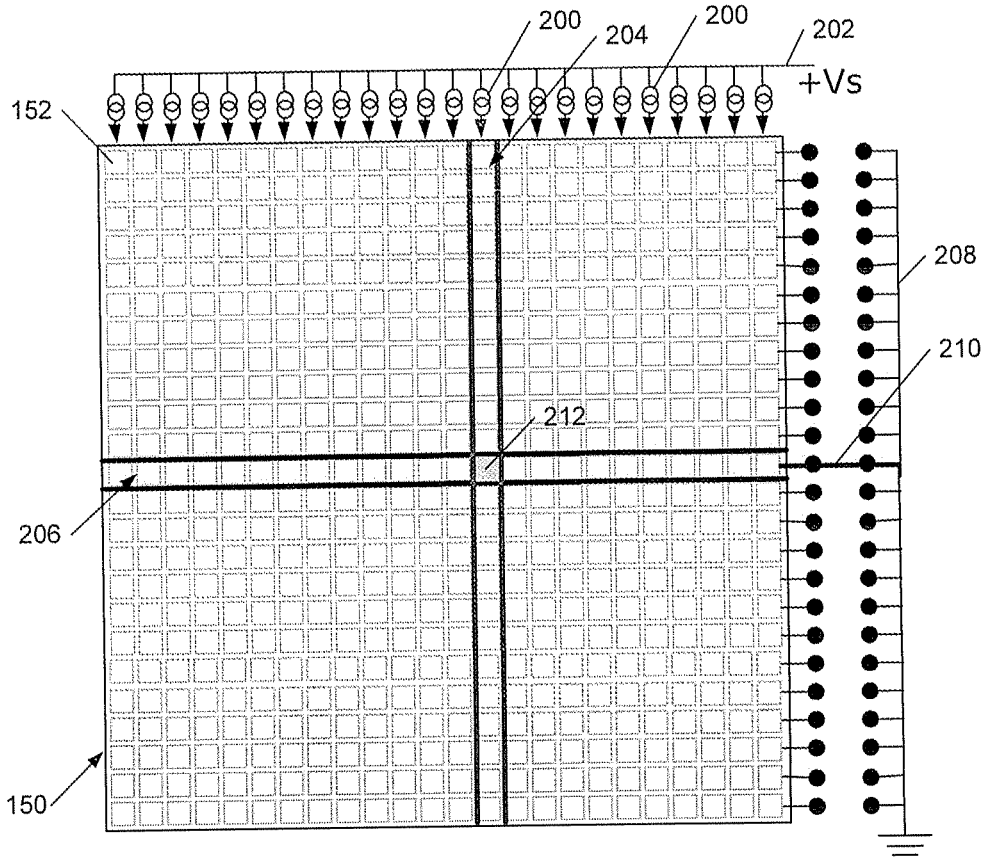
Figure 2 (PRIOR ART)
FIG. 2 shows conceptually a driving arrangement for a passive matrix OLED display.
Figure 3:
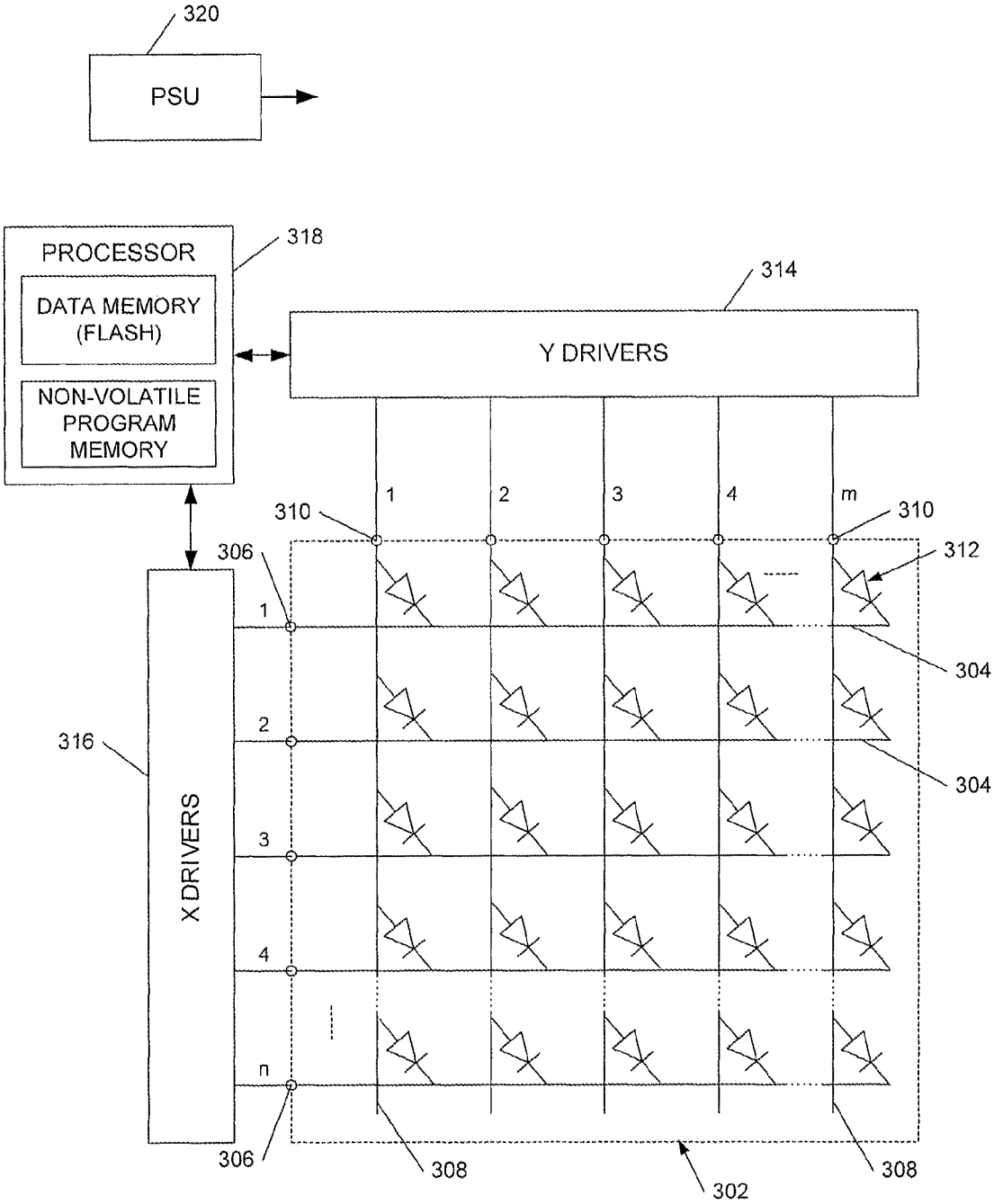
Figure 3 (PRIOR ART)
FIG. 3 shows a block diagram of a passive matrix OLED display driver suitable for embodying an aspect of the present invention.

Referring back once more to FIG. 3, the skilled person will readily appreciate that the voltage drop across an OLED is effectively directly available via the row and column electrodes of the display, albeit preferably with line resistance calibrated out. In FIG. 3 the non-volatile programme memory may be employed to store a procedure for implementing embodiments of the invention for example as shown FIG. 4*c*, and the data memory may be employed, for example, to store pixel efficiency value data.

Figure 5A:
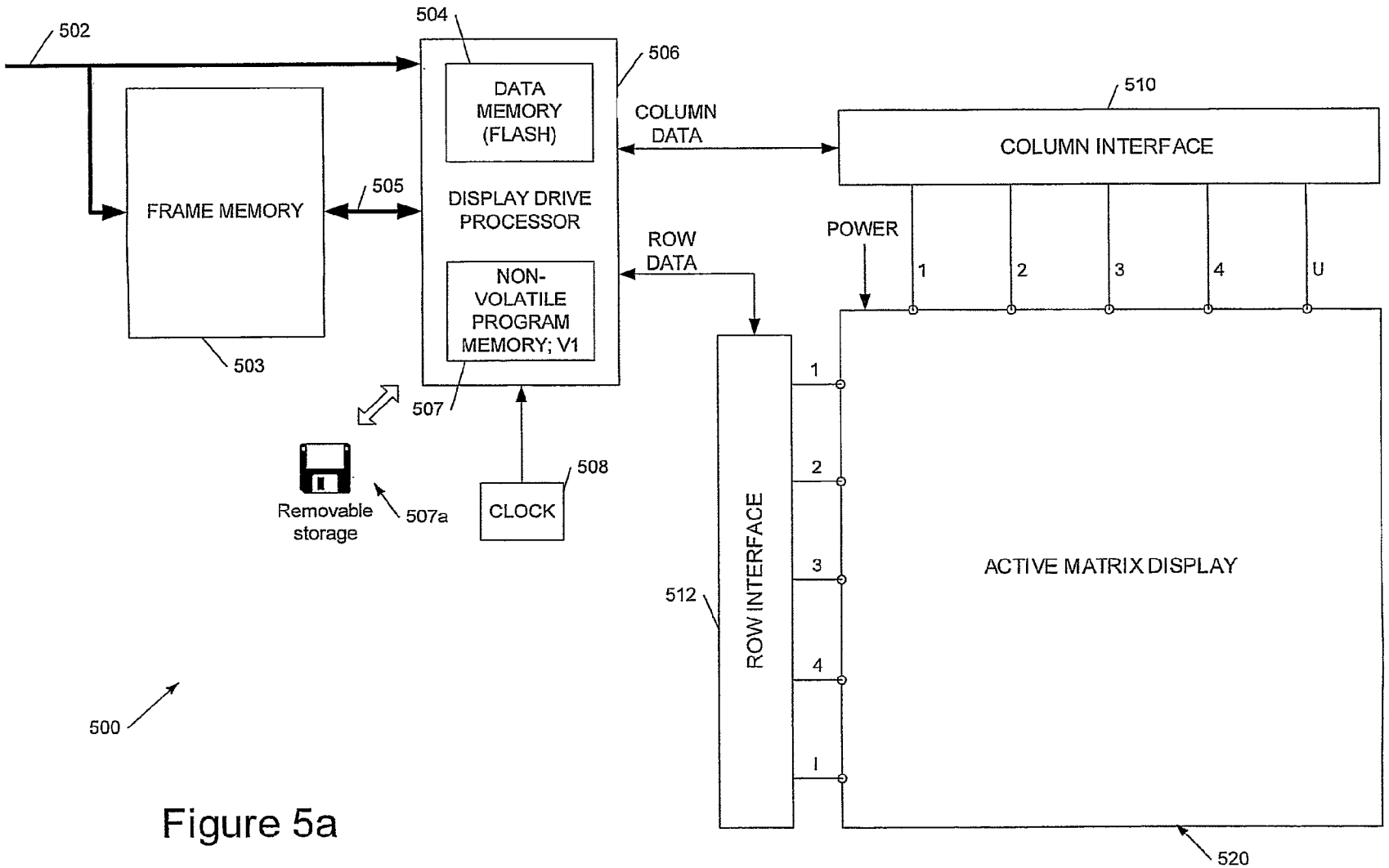
FIGS. 5*a* to 5*d* show, respectively, an active matrix display driver embodying an aspect of the present invention, a conceptual diagram of a first example of an active matrix pixel driver circuit suitable for measuring the voltage drop across an OLED device of the pixel, a detailed example of a voltage-controlled active matrix pixel driver circuit configured for measuring the voltage drop across an OLED device of the pixel, and, a detailed example of a current-controlled active matrix pixel driver circuit configured for measuring the voltage drop across an OLED device of the pixel.

FIG. 5*a* shows an example of an active matrix OLED display controller 500 which may, likewise, include code for implementing a procedure according to an embodiment of the invention in the non-volatile programme memory (preferably also stores data defining a value of $V_1$) and data memory, for example Flash memory storing pixel efficiency value or other drive compensation data.

In more detail the OLED driver system 500 comprises a data and control bus 502, which may be either serial or parallel, to receive data for display. In the example illustrated this provides an input to a frame store memory 503 which stores luminance and optionally colour data for pixels of the display and which provides an interface via a second bus 505 to a display drive processor 506. Processor 506 may be implemented entirely in hardware or in software using, for example, a digital signal processing core, or in a combination of the two such as software with hardware acceleration. In the illustrated embodiment a processor 506 has a clock 508 and includes programme memory 507 and data/working memory 504; some or all of the contents of either or both of these memories may be provided on a carrier medium, illustratively shown by removal storage medium 507*a*.

Processor 506 has bidirectional connections 509, 511 with column interface circuitry 510 and row interface circuitry 512 for an active matrix display 520. The bidirectional connections allow row and column data to be provided to the display 520 and voltage drop data to be read from the display 520. (In other arrangements only the connection to one of the row and column interfaces is bidirectional; in still others a separate connection is provided to receive voltage drop data from the display).

In the above-described embodiments a voltage drop of at least one active display pixel is read. There is a number of ways to achieve this for an active matrix OLED display.

One option is to include dedicated sensing circuitry and associated connections in the space between pixel circuits in a top-emitting display, where the pixel drive circuitry is not precisely aligned with the overlying OLED pixels, as described in more detail in our co-pending UK patent application no. 0612973.8 filed 30 Jun. 2006 and equivalents thereof hereby incorporated by reference in its entirety.

Another technique is similar to that described in the applicant's international patent applications WO 03/107313 and WO 03/107318 (hereby incorporated by reference in their entirety).

The overall power supply voltage to the active matrix display (or to a specific row or column thereof) is controlled and the current drawn by the display is monitored, whilst displaying a pattern of pixels which are to be monitored. The voltage drop across the source-drain connections of a field effect transistor is substantially constant at a known value (dependent upon the current) whilst the transistor is in saturation. Thus the overall power supply to the active matrix display can be reduced until a knee in the supply current is identified, that is identifying the point at which the total supply current begins to drop significantly. At this point the drain-source voltage drop across the transistor is known, the overall power supply voltage is known and therefore the voltage drop across the OLED device can be calculated by subtracting the drain-source voltage from the total supply voltage. This technique can also be applied for each row and/or column of the display separately.

Figure 5B:
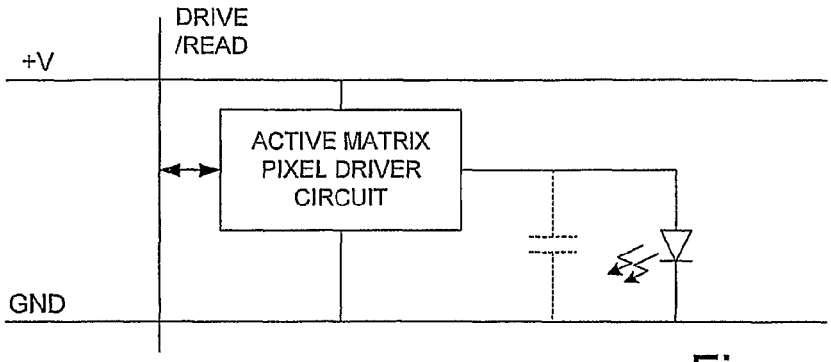

FIG. 5*b* show, conceptually, a further alternative approach in which a capacitor is connected across the OLED and then afterwards discharged, a measurement of the charge during the discharge being proportional to the voltage across the OLED device.

Figure 5C:
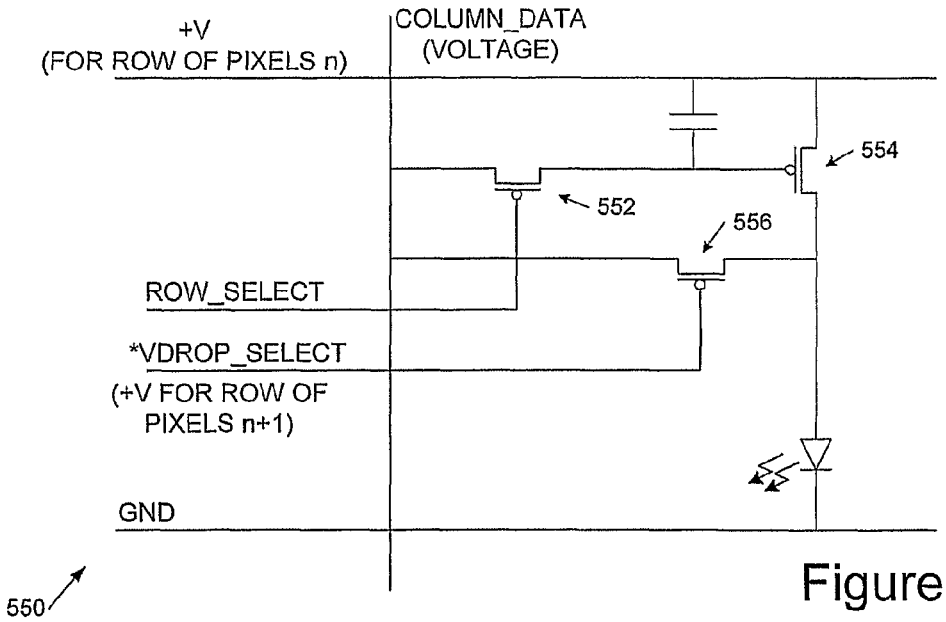

FIG. 5*c* shows an example of a voltage-controlled active matrix pixel driver circuit 550 in which a first select transistor 552 couples the column data line to the gate of a drive transistor 554, and in which a second select transistor 556 couples the column data line to a terminal of the OLED device driven by the drive transistor (the other terminal being connected to ground). Bringing the gate of transistor 556 low switches the transistor on and in embodiments this select line may be coupled to a supply line for the next row of pixels in order that an additional select line is not required.

Figure 5D:
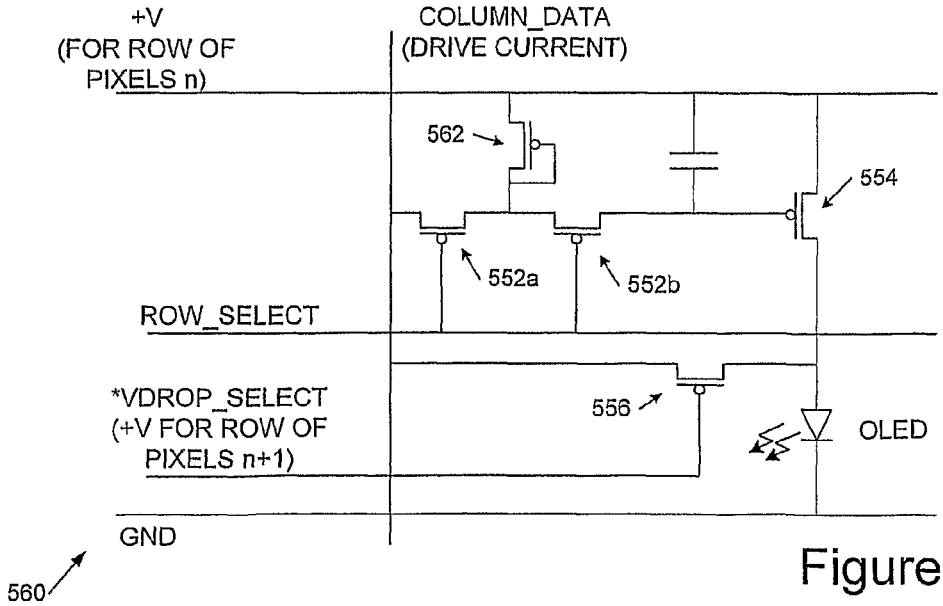

FIG. 5*d* shows another example of an active matrix pixel drive circuit 560 incorporating a similar select transistor (like elements are indicated by like reference numerals), but in this case illustrating a current-controlled rather than a voltage-controlled circuit (transistor 562 forms a current mirror with drive transistor 554). In a still further example circuit (not shown) transistor 562 may be replaced with a photodiode so that the column drive programmes a light output from the OLED device.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of controlling a drive to a pixel of an OLED display having a test pixel and display pixels, the method comprising determining a drive current for the pixel to be controlled by first calculating a value of $\eta/\eta_0$ using:

$$V_{now}^{test} = V_{now}^{other} - 2V_1\left(1 - \frac{\eta}{\eta_0}\right)$$

where $V_{now}^{test}$ is the voltage drop measured across the test pixel at a test drive current, $\eta_0$ is the luminance efficiency of said test pixel at said test drive current at an initial time; $V_{now}^{other}$ is the voltage drop measured across at least one other pixel to be controlled at said test drive current, and $V_1$ is the end of life voltage increase in said voltage drive for said test drive current; and scaling the drive current to the pixel to be controlled by multiplying the drive current requested by the value $\eta_0/\eta$.

2. A method as claimed in claim 1 wherein said value ($V_1$) represents the loss in efficiency of said display and comprises a stored value representing an increase in a pixel drive voltage needed to compensate for a defined level of efficiency reduction.

3. A method as claimed in claim 1 wherein said measuring of said voltage drops is performed at switch-on of said display.

4. A method as claimed in claim 1 comprising measuring $V_{now}^{other}$ for a plurality of pixels of said display and calculating an average from said measured plurality of voltage drops for use in said determining of the value of $\eta/\eta_0$.

5. A method as claimed in claim 1 comprising measuring $V_{now}^{other}$ for a plurality of pixels of said display, wherein said controlling comprises determining respective values for $\eta_0/\eta$ for said plurality of pixels, and using the respective ones of said values $\eta_0/\eta$ for compensating a drive for respective ones of said plurality of pixels.

6. A method as claimed in claim 1 wherein said test pixel comprises a pixel of the display which is not used for displaying information.

7. A method as claimed in claim 1 wherein said test pixel comprises a pixel in a region of said display used for displaying information.

8. A method as claimed in claim 7 wherein said test pixel is selected from the 20% of pixels of said display having least aging.

9. A method as claimed in claim 8 wherein said test pixel comprises a substantially least aged pixel of said display.

10. A method as claimed in claim 7 further comprising measuring a time for which said test pixel is on at greater than threshold drive level; and wherein said determining of said value $\eta_0/\eta$ comprises compensating for temperature using said measured on-time.

11. A carrier carrying processor control code for implementing the method of claim 1.

12. An active matrix OLED display having a test pixel and display pixels, the display comprising:

a display controller configured to determine a drive current for a pixel of an OLED display, the pixel to be controlled by first calculating a value of $\eta/\eta_0$ using:

$$V_{now}^{test} = V_{now}^{other} - 2V_1\left(1 - \frac{\eta}{\eta_0}\right)$$

where $V_{now}^{test}$ is the voltage drop measured across a test pixel at a test drive current, $\eta_0$ is the luminance efficiency of said test pixel at said test drive current at an initial time; $V_{now}^{other}$ is the voltage drop measured across at least one other pixel to be controlled at said test drive current, and $V_1$ is the end of life voltage increase in said voltage drive for said test drive current; and the display controller configured to scale the drive current to the pixel to be controlled by multiplying the drive current requested by the value $\eta_0/\eta$, the display controller comprising:

an input for measuring a first voltage drop across at least one test pixel of the display;

an input for measuring a second voltage drop across at least one other pixel of the display;

a store storing a value ($V_1$) representing a drive voltage increase for a loss in efficiency of said display;

a system for determining an estimated reduction in efficiency ($\eta_0/\eta$) of said display from said first and second voltages and said value ($V_1$); and a system for scaling the drive current to said pixel using said estimated efficiency reduction, wherein said active matrix OLED display further comprises a matrix of pixel driver circuits, each pixel driver circuit including a transistor having an input connection coupled to an OLED device of the pixel for measuring a voltage across said OLED device, an output coupled to a first electrode line of said display and a control connection coupled to a second electrode line of said display.

13. An active matrix OLED display as claimed in claim 12 wherein for a pixel driver circuit in a row or column of said display said second electrode line comprises a power supply line of an adjacent row or column of said display.

14. An active matrix OLED display as claimed in claim 13 wherein said second electrode line comprises a positive supply line and wherein said transistor is controlled on by pulling said control connection low.

* * * * *